US005460529A

United States Patent [19]

Moyers

[11] Patent Number: 5,460,529

[45] Date of Patent: Oct. 24, 1995

[54] TARGET SIMULATOR DEVICE AND TECHNIQUE

[75] Inventor: Thomas E. Moyers, Woodbridge, Va.

[73] Assignee: The United States of America as represented by the Secretary of the Army, Washington, D.C.

[21] Appl. No.: 261,277

[22] Filed: Jun. 15, 1994

[51] Int. Cl.[6] ..... G09B 25/00

[52] U.S. Cl. ..... 434/365; 434/4; 434/21

[58] Field of Search ..... 434/12, 16, 2, 434/4, 19–22, 27, 365; 273/310–348.1, 348; 73/657; 250/216, 330, 342; 356/11, 141.1; 359/641, 795; 353/11; 310/335; 381/190

[56] References Cited

U.S. PATENT DOCUMENTS

| | | | |
|---|---|---|---|
| 3,694,654 | 9/1972 | Crownover | 250/352 X |
| 4,009,392 | 2/1977 | Hanley | 250/342 X |
| 4,218,138 | 8/1980 | Robertsson | 434/21 X |
| 4,218,834 | 8/1980 | Robertsson | 434/21 |
| 4,533,144 | 8/1985 | Juarez et al. | 434/21 X |
| 4,662,845 | 5/1987 | Gallagher et al. | 273/372 X |
| 4,723,448 | 2/1988 | Veligdan | 73/657 |
| 4,743,032 | 5/1988 | Summers et al. | 273/372 |
| 4,784,154 | 11/1988 | Shirley et al. | 381/190 X |
| 4,845,776 | 7/1989 | Bittencourt | 381/190 |
| 4,898,391 | 2/1990 | Kelly et al. | 434/22 X |
| 5,212,384 | 5/1993 | Fouilloy | 250/342 X |
| 5,224,860 | 7/1993 | Waldman et al. | 273/348.1 X |
| 5,321,263 | 6/1994 | Filo | 273/348.1 X |

FOREIGN PATENT DOCUMENTS

| | | | |
|---|---|---|---|
| 0185877 | 7/1986 | European Pat. Off. | 273/348.1 |
| 4029882 | 3/1992 | Germany | 273/348.1 |
| 595606 | 2/1978 | Switzerland | 273/372 |

OTHER PUBLICATIONS

"Loudspeaker"; McGraw–Hill Encyclopedia of Science and Technology, 5th Edition; vol. 7; 1982; pp. 813–818.

*Primary Examiner*—Joe H. Cheng

*Attorney, Agent, or Firm*—Milton W. Lee; Alain L. Bashore; Anthony T. Lane

[57] ABSTRACT

A target simulator device for the simulation of infrared targets as input to entrance optics. A voice coil of an audio loud speaker including a cone portion and two electrical input connections has a physical projection one end of which is coupled to the cone portion and the other end approximate to and in front of a shield aperture. A black body radiation source is placed behind the aperture and a frequency compensated amplifier electrically coupled to the input connections such that collimated signal-modulated black body energy that is proportional to the total range of frequencies input is observed by an infrared sensitive detector aligned with the radiation emanating from the aperture.

1 Claim, 2 Drawing Sheets

TARGET SIMULATOR DEVICE AND TECHNIQUE

BACKGROUND OF THE INVENTION

1. Field of the Invention

The present invention generally relates to target simulator techniques and devices and more specifically, to an infrared energy modulator technique and device for simulation of infrared targets.

2. Description of Prior Art

A non-cooperative target recognizer (NCTR) has been under development for several years yet, there has been no cost effective method or device in the prior art that can effectively simulate signals of real infrared targets. A device is needed that can insert prerecorded or simulated target signatures into the entrance optics, and thus detected by the infrared sensitive detector to be used in a NCTR. This would make it possible to verify system readiness in the field by non-expert personnel. Currently, the only means of testing overall system performance is through very expensive and time consuming laboratory computer analysis and actual field tests.

While the prior art has reported using target simulation none have established a basis for a specific apparatus that is dedicated to the task of resolving the particular problem at hand. What is needed in this instance is a device and technique that can effectively simulate infrared target signatures.

SUMMARY OF THE INVENTION

It is therefore one object of the invention to provide a device and technique that can effectively simulate infrared target signatures.

According to the invention, a target simulator device for the simulation of infrared targets is disclosed as input to entrance optics. A voice coil of an audio loud speaker including a cone portion and two electrical input connections has a physical projection one end of which is coupled to the cone portion and the other end approximate to and in front of an aperture. A black body radiation source is placed behind the aperture and a frequency compensated amplifier electrically coupled to the input connections such that signal-modulated black body energy that is proportional to the total range of frequencies input is observed by entrance optics in front of the aperture. A data collection run or its recorded equivalent is input as electrical impulses. The electrical impulses generate proportional movement of the physical projection in proximity to the aperture such that there results a simulated proportional modulation of the viewed black body. The input to the amplifier can be mixed to simulate target signals or prerecorded actual target signals can be used.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
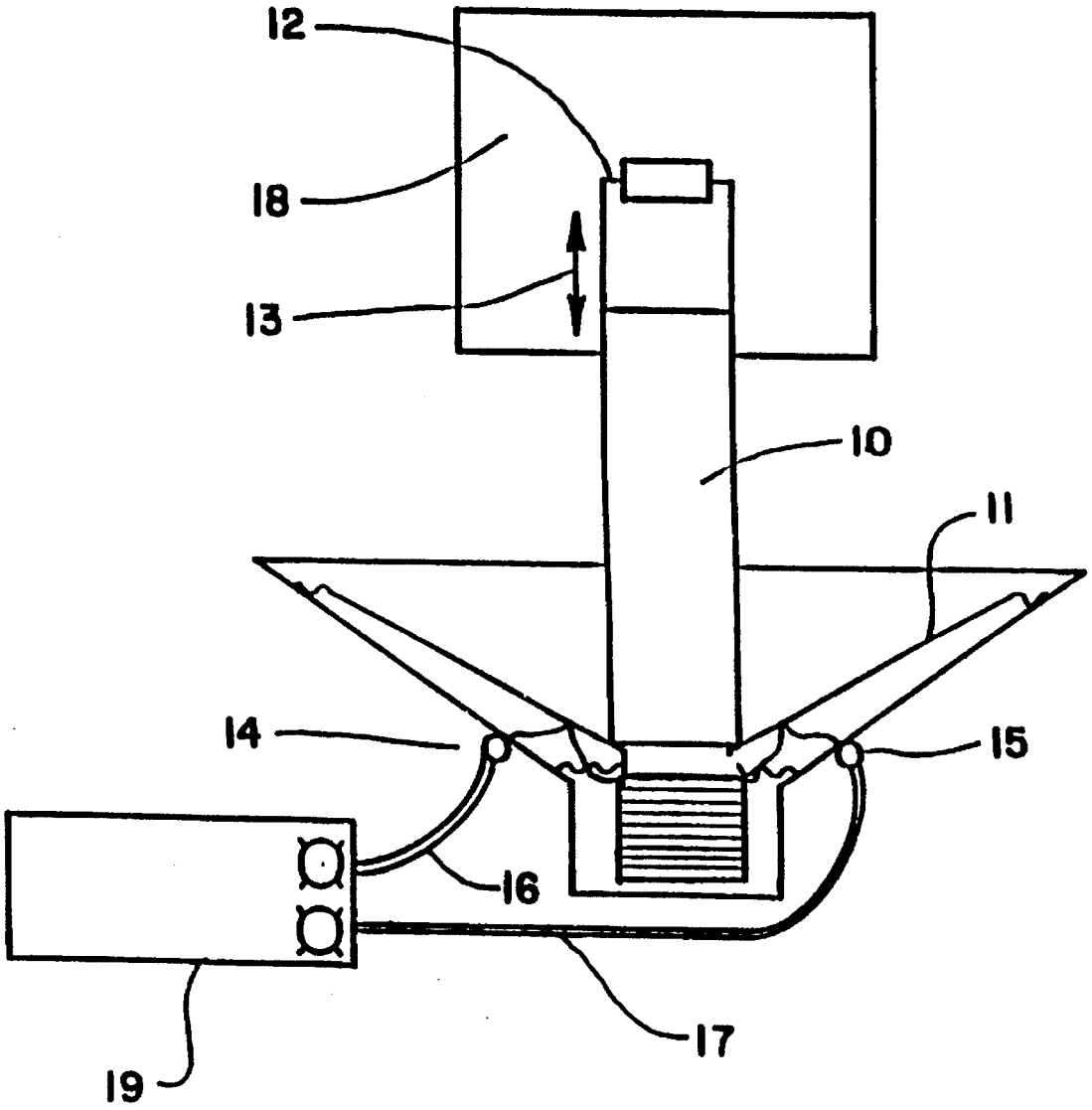
FIG. 1 is a front view of the infrared energy modulator device.

Referring now to the drawings, and more particularly to FIG. 1, there is shown a front view of the infrared energy modulator device of the present invention. A conventional voice coil apparatus similar to that found in an audio loudspeaker is utilized, the operation of which per se is understood to be known in the Prior Art. Briefly described, electrical impulses (such as from a receiver) proportionally drive an electro-magnetic coil which in turn drives a cone coupled above the coil. In this way there is converted electrical impulses to audio sounds as the cone proportionally deflects. A more through description of an audio loudspeaker may be found in McGraw-Hill Encyclopedia of Science and Technology, 5th Edition; Volume 7, pages 813–818.

Figure 2:
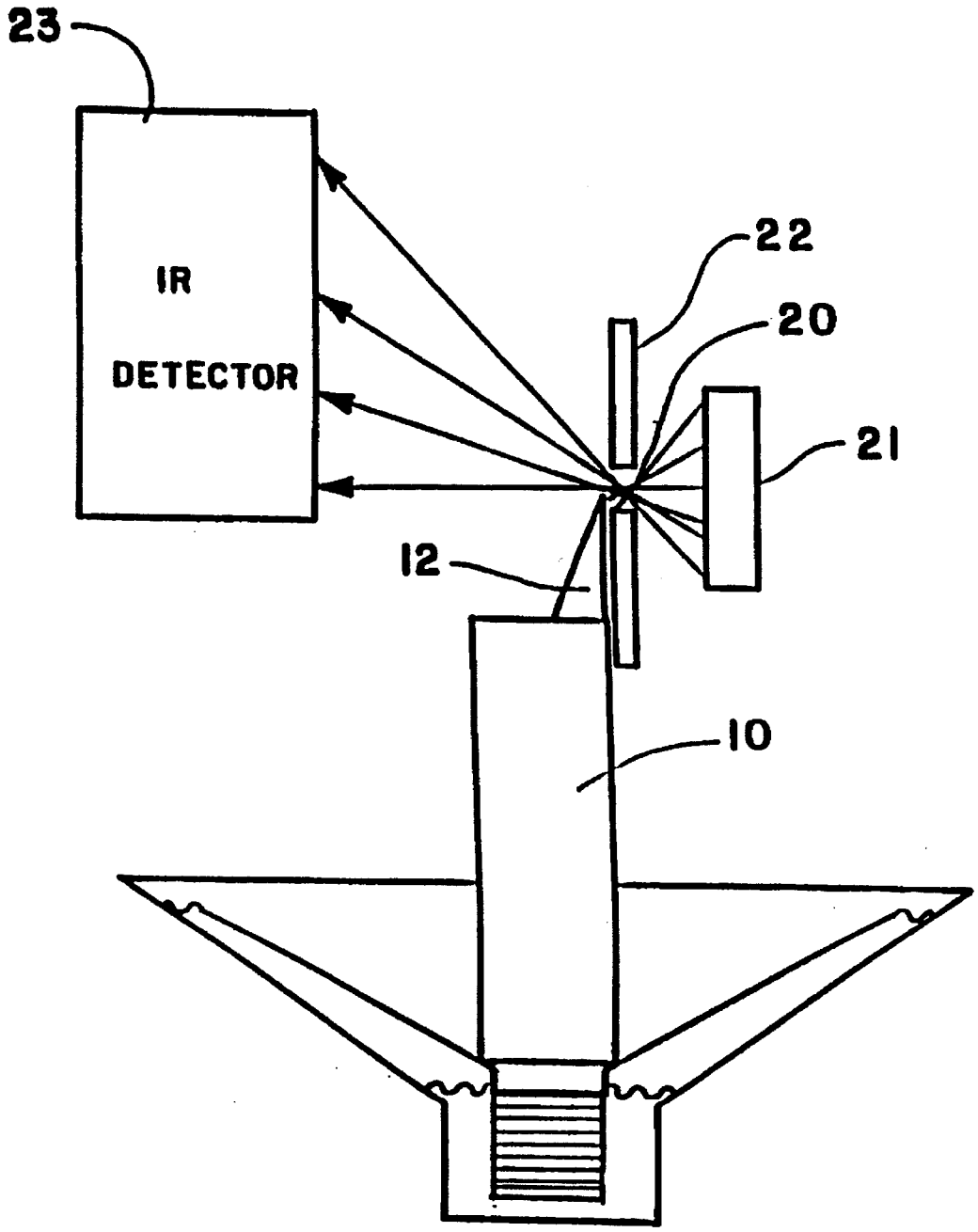
FIG. 2 is a side view of the infrared energy modulator device.

The present invention utilizes the conventional voice coil apparatus in a unique and unobvious way. A physical projection, shown as vane 10 is coupled to cone portion 11 such that vane 10 including knife edge 12 is moved up and down in direction 13 in proximity to aperture 20 of FIG. 2 when cone portion 11 proportionally deflects due to the electrical impulse input. It is understood that the physical projection of the present embodiment is not limited to that shown in FIGS. 1 and 2. A heated black body source 21 is placed behind shield 22. Radiation emanations that project through the aperture, are modulated by the movement of knife edge 12 during operation and this is detected as signal-modulated black body radiation by infrared detector 20.

The voice coil apparatus of FIG. 1 is driven by frequency compensated amplifier 19. Frequency compensation is required to assure that the amount of physical movement of the vane in direction 13 is the same for the total range of frequencies of interest. Input connections 14 and 15 are coupled to leads 16 and 17 which transfer frequency compensated input from the amplifier. Frequency or signal synthesizer output signals can be mixed to simulate target signals or prerecorded actual target signals can also be used.

A data collection run or its recorded equivalent is input as electrical impulses through leads 16 and 17. The electrical impulses generate proportional movement of vane 11 such that there results a proportional modulation of the viewed black body 21 as viewed through the input optics utilized. The input to the amplifier can be mixed to simulate target signals or prerecorded actual target signals can be used. The device and technique of the present invention allows the capability to produce simulated signal-modulated black body energy for input to a infrared sensitive detector.

While this invention has been described in terms of preferred embodiment consisting of an infrared modulator, those skilled in the art will recognize that the invention can be practiced with modification within the spirit and scope of the appended claims.

Having thus described my invention, what I claim as new and desire to secure by Letters Patent is as follows:

1. A target simulator device for the simulation of infrared target signatures to be observed by an infrared sensitive detector, including:

an audio loudspeaker, further including an audio coil coupled to a cone portion and two electrical input connections;

a means for physical projection, with first and second ends, the first end of which is coupled to the cone portion;

a black body radiation source;

a means for shielding the black body radiation source, with two sides, interposed between the black body radiation source and at least a portion of the means for physical projection, further including an aperture located approximate to the black body radiation source on the one side and on the other side approximate to the second end;

a frequency compensated amplifier electrically coupled to the input connections for driving the audio coil when input electrical impulses are present, such that input electrical impulses generate proportional movement of the second end in proximity to the aperture, resulting in the radiation emanating from the aperture being modulated as seen by the infrared sensitive detector approximately aligned with the radiation emanating from the aperture, thus effecting a simulation of proportional signal-modulated black body radiation that is observed by the infrared sensitive detector as target signatures.

* * * * *